US006192106B1

(12) United States Patent
Miller et al.

(10) Patent No.: US 6,192,106 B1
(45) Date of Patent: Feb. 20, 2001

(54) FIELD SERVICE FLASHABLE GETTER FOR X-RAY TUBES

(75) Inventors: Lester D. Miller, Hudson, OH (US); Allan D. Kautz, Naperville, IL (US)

(73) Assignee: Picker International, Inc., Cleveland, OH (US)

( * ) Notice: Under 35 U.S.C. 154(b), the term of this patent shall be extended for 0 days.

(21) Appl. No.: 09/248,599

(22) Filed: Feb. 11, 1999

(51) Int. Cl.[7] ..... H01J 35/20
(52) U.S. Cl. ..... 378/123; 378/121
(58) Field of Search ..... 378/119, 121, 378/123, 136

(56) References Cited

U.S. PATENT DOCUMENTS

| | | | |
|---|---|---|---|
| 2,668,253 | 2/1954 | Taylor . | |
| 2,988,657 | 6/1961 | Klopfer et al. . | |
| 4,685,118 | 8/1987 | Furbee et al. | 378/114 |
| 4,853,946 | 8/1989 | Elliott et al. . | |
| 5,438,605 | 8/1995 | Burke et al. . | |
| 5,453,659 | 9/1995 | Wallace et al. . | |
| 5,509,045 | 4/1996 | Kautz | 378/123 |
| 5,685,963 | 11/1997 | Lorimer et al. . | |
| 5,734,226 | 3/1998 | Cathey . | |
| 5,838,761 | 11/1998 | Behner et al. | 378/123 |
| 6,044,129 * | 3/2000 | Miller et al. | 378/125 |

FOREIGN PATENT DOCUMENTS

| | | |
|---|---|---|
| 546846 | 7/1942 | (GB) . |
| 60-172154 | 9/1985 | (JP) . |
| 8-153460 | 6/1996 | (JP) . |

* cited by examiner

*Primary Examiner*—David P. Porta
*Assistant Examiner*—Drew A. Dunn
(74) *Attorney, Agent, or Firm*—Timothy B. Gurin; John J. Fry; Eugene E. Clair

(57) ABSTRACT

An evacuated tube (24) includes an envelope (50) and an electrode (78) in the tube envelope (50). The electrode (78) is electrically connected to conductors **(74*a*, 74*b*) that extend through the tube envelope (50). A getter (72) is included in the tube envelope (50) and is electrically connected to the conductors (74*a*, 74*b*) extending through the tube envelope (50). Diodes (82*a*, 82*b*) are connected to the electrode (78) and the getter (72) for selectively providing electrical energy through the conductors (74*a*, 74*b*) extending through the tube envelope (50) to one of the electrode (78) and the getter (72)**.

57 Claims, 8 Drawing Sheets

FIELD SERVICE FLASHABLE GETTER FOR X-RAY TUBES

BACKGROUND OF THE INVENTION

The present invention relates to x-ray tubes and is particularly related to an apparatus for use in improving the performance and/or extending the service life of an x-ray tube by selectively improving performance of gas pressure reducing materials in x-ray tubes installed in operating x-ray imaging systems. The present invention finds particular application in conjunction with activating a getter by depositing and/or actuating getter material surface area in x-ray tubes installed in operating imaging systems when improved getter pumping rates are desired. It will be appreciated, however, that the invention is applicable in other applications where it is necessary to improve getter pumping rate in a vacuum tube or envelope.

The useful life and performance of an x-ray tube are affected by the maintenance of an appropriate vacuum within the tube throughout its operative life. For this reason, creating and maintaining an adequate vacuum over the planned life of the x-ray tube is important. Contaminants that are present in an operating x-ray tube evolve into gases over the life of the tube during normal tube operation. These evolved gases reduce the vacuum level in the tube during its service life.

Production of a tube or envelope that can maintain an adequate vacuum during operation includes removing residual contaminants left on the tube components. During manufacture the tube components are cleaned and baked in vacuum furnaces. This procedure reduces the amount of surface contaminants available to evolve into gases when the tubes are in service.

The cleaned x-ray tube components are then assembled and placed within an envelope. The envelope is evacuated using a vacuum pump and sealed from the outside environment. During the pumping process the x-ray tube is heated to further reduce contaminants.

A getter material typically is located in the vacuum envelope. After the vacuum pump has established a vacuum, the getter material is activated. Depending on the type of material, getters are classified as either (i) evaporable or (ii) non-evaporable e.g, a bulk getter. Activating the getter material may include (i) flashing the getter for an evaporable material or (ii) actuating the getter by raising its temperature for a bulk or non-evaporable getter.

One method of activating (flashing) an evaporable getter is accomplished by locating a source for an electromagnetic field, usually an RF field, outside the evacuated envelope proximate to the getter coil located inside the envelope. The electromagnetic field is generated and couples with the getter coil, thereby inducing current flow in the coil and heating the getter material in contact with the coil. The heated getter material evaporates and atoms leaving the getter surface are deposited on interior surfaces of the envelope and other internal components. The freshly deposited getter material plated on the interior surfaces absorb additional amounts of residual gas molecules. However, once an x-ray tube is installed in a housing this method of flashing the getter is not easily accomplished. Another method of activating the getter by flashing includes applying electric current directly to the getter material via dedicated terminals. The getter is heated by resistance heating thereby raising the temperature of the getter material to that necessary to evaporate the getter.

In these types of getters, the getter film produced by flashing reacts with all the residual active gasses and, by chemisorption, removes them from the gas phase to further reduce the gas pressure within the evacuated envelope. However, the sorption capacity of the deposited getter material is limited. As sorption capacity is approached, the ability of the getter to sorb additional gas molecules is diminished. The reacted layer includes oxides and additional compounds that include the other evolved and absorbed gasses.

Non-evaporable, or bulk, getters are temperature activated and do not need to be evaporated to be activated. These types of getters are activated by supplying specified electric current levels to the getter causing resistance heating to elevate the getter material to a desired temperature. Once the getter reaches the desired temperature the specific gas molecules are absorbed into the getter. The vacuum in the x-ray tube may be getter pumped to the desired gas pressure level using either a flashed getter or a bulk getter.

The completed x-ray tube is then mounted into the housing or enclosure that is filled with dielectric oil. Once the oil filled housing containing the x-ray tube is installed in an operative x-ray system, the components continue to evolve gas into the evacuated envelope. The evolved gas is also produced from contaminants that migrate via diffusion through the tube components to their surfaces. These gases react with the getter material that was flashed during the original manufacturing process. As the tube continues to operate and contaminants are absorbed by the getter, sorption capacity of the getter material is reached. The getter material becomes less efficient in removing gas molecules and the gas pressure in the evacuated envelope increases.

When gas pressures within the evacuated region of the x-ray tube increase, the mean free path between gas molecules is reduced such that a chain reaction is more likely to occur when the gas molecules in the vacuum envelope are ionized by the high electric fields generated during normal tube operation. This chain reaction is called avalanche and is a form of arcing. An arc is an undesired surge of electrical current between two elements which are at a different electrical potential and typically occurs through the gas molecules present in the x-ray tube. In x-ray tubes, this tendency to arc often increases as the tube ages due to such factors as degradation of the vacuum within the tube due to the existence of additional undesired gas molecules. When the x-ray tube arcs, a current on the order of hundreds of amperes can flow between the cathode and the anode. Once an x-ray tube starts to arc an avalanche type effect may occur, sputtering metal and metal atoms as well as ionizing the contaminants in the vacuum. In addition, arcing in an x-ray tube used in a Computed Tomography (CT) imaging system contaminates the signal collected at the detectors and affects proper image reconstruction. This may result in an un-usable set of data requiring another CT scan of the patient.

Arcing typically occurs in the area of the x-ray tube having the highest electric field strength. As such, arcing in an x-ray tube may commonly occur in the same region as where the cathode is supplying the anode with electrons for the production of x-ray emissions. The sputtering of metal from the cathode produced during arcing often lands on the internal surface of the glass envelope in proximity to the cathode. The existence of the metal deposits on the glass envelope can deleteriously affect x-ray tube performance. Sputtering of metal within the envelope may as internal pressure increases, even in the absence of an arc.

SUMMARY OF THE INVENTION

Thus, it is desirable to have the ability to decrease the gas pressure to an appropriate level in an x-ray tube that has been in service. However, once the tube is installed in an operative system, access to the tube is restricted such that it is difficult to re-establish an appropriate vacuum in the tube. This makes it difficult to activate or deposit the appropriate amount of getter material to improve the vacuum to a desired level. Thus, to decrease gas pressure it is desirable to deposit or activate additional getter material in an installed x-ray tube to improve the vacuum in a tube that is already operational in a system installed in the field. In addition, when a flashable getter is activated, it is also desirable to control the amount of getter material that is deposited during a flash. By controlling the amount of getter material deposited during a specific flash of the getter, a predetermined desired amount of getter material may be deposited and a portion of getter material may be reserved for a future flash when required.

Since service and exposure rates vary from system to system, depending on usage, the vacuum levels will deteriorate at different rates from tube to tube. It is desirable to be able to determine when the vacuum is, or may be, at a level that requires flashing additional getter material to improve the pumping rate. It is also desirable to controllably flash the getter material in response to monitored x-ray tube operating characteristics.

Many tubes are installed in operating imaging systems and the number of electrical connections through the evacuated enclosure are fixed or standardized. It is desirable to provide a new tube that can solve the above referenced problems as a straight forward replacement tube in existing systems and wiring configurations.

The present invention provides a new and improved vacuum improving apparatus and method for use with evacuated tubes and envelopes which overcomes the above-referenced problems and others.

The present invention is directed to a getter arrangement in an evacuated envelope and getter deposit and/or activation control that satisfies the need to extend tube service life and improve performance by selectively improving getter pumping efficiency thereby providing an improved vacuum in tubes installed in operating imaging systems. An apparatus in accordance with one embodiment of the present invention includes an evacuated tube envelope and an electrode in the tube envelope. A getter is installed in the tube envelope and is electrically connected to a conductor. The conductor is electrically connected to both of the getter and the electrode. The apparatus includes means for selectively providing electrical energy through the conductor to one of the electrode and the getter.

In accordance with a more limited aspect of the present invention, the apparatus includes a cathode as the electrode.

Another limited aspect of the present invention includes at least a diode or inductor as the means for selectively providing electrical energy to the getter.

In accordance with another aspect of the present invention, an x-ray tube comprises a substantially evacuated envelope. An anode is located within the envelope. A cathode filament is located in the envelope. The x-ray tube further includes at least one getter located within the envelope. At least one conductor is included that is electrically connected to both of the cathode filament and the getter.

In accordance with a more limited aspect of the invention the x-ray tube includes a plurality of getters within the tube and the apparatus includes means for selectively activating at least one of the plurality of getters.

In accordance with a yet more limited aspect of the invention, the x-ray tube includes a diode in the means for selectively activating the at least one of the plurality of getters. In an alternate more limited aspect of the invention a capacitor is included in the means for selectively activating the at least one of the plurality of getters. In a yet more limited aspect of the present invention, the diode (or capacitor) is connected in series with the cathode filament.

In yet another aspect of the present invention, an apparatus for activating a getter includes an enclosed tube having a tube wall. The getter is electrically connected to at least one conductor extending through the tube wall. The apparatus comprises means for providing a signal indicative of tube performance. The apparatus also includes means for selectively activating one of the electrode and the getter in response to the signal indicative of tube performance.

In accordance with a more limited aspect of the invention, the selective activating means includes a controller in data communication with the signal providing means.

In a more limited aspect of the invention the signal indicative of tube performance includes a signal indicative of at least one of arc rate, gas pressure, operating cycles, starts, exposures, number of scans, current, voltage and temperature.

In accordance with another aspect of the present invention, an apparatus for controllably activating a getter in an envelope comprises a pressure measuring device advantageously located to determine a measure of the gas pressure within the envelope. The pressure measuring device provides a signal indicative of a measure of the gas pressure within the envelope. A source of electrical energy is operatively connected to the getter and a controller is controllably connected to both of (i) the pressure measuring device and (ii) the source of electrical energy. The controller activates the source of electrical energy in response to the signal provided by the pressure measuring device.

In a more limited aspect of the present invention, the controller determines the amount of electrical energy to apply to the getter in response to the signal provided by the pressure measuring device.

In another limited aspect of the invention, the pressure measuring device is an ionization gauge that includes an anode and a cathode located within the envelope.

In accordance with another aspect of the present invention, an apparatus comprises an envelope that is substantially evacuated having a first getter located within the envelope. The first getter has a first end electrically connected to a first terminal extending through the envelope and a second end electrically connected to a second terminal extending through the envelope. A second getter located within the envelope.

In accordance with a more limited aspect of the invention, the second getter has a first end electrically connected to a third terminal extending through the envelope and a second end electrically connected to at least one of the first and second terminal.

In accordance with another aspect of the present invention, a method is provided for maintaining a pressure level in an enclosed evacuated electrode tube. The method comprises the steps of providing a signal indicative of tube performance and activating getter material in response to the signal indicative of tube performance.

In a more limited aspect of the present invention the signal indicative of tube performance includes at least one of arc rate, gas pressure, exposure count, number of scans, operating cycles, starts, current, voltage and temperature.

In another more limited aspect of the present invention, the step of activating the getter includes the step of evaporating getter material.

In yet a more limited aspect of the present invention, the method includes the step of determining the amount of getter material to activate prior to the step of activating.

In accordance with another more limited aspect of the present invention, the step of activating the getter includes the step of controlling the amount of getter material evaporated. And a further limited aspect includes a step of evaporating only a portion of the getter material for a discrete activation step. And yet another limited aspect of the present invention includes the step of determining the amount of getter material remaining.

In accordance with another limited aspect of the present invention, the method includes the steps of monitoring the signals indicative of tube performance and storing values associated with the monitored signals.

In accordance with another aspect of the present invention, a method of maintaining a substantial vacuum in an x-ray tube comprises the steps of sensing gas pressure in the tube, providing a signal indicative of the gas pressure and activating the getter material in response to the signal.

In accordance with yet another aspect of the present invention, an imaging apparatus comprises an x-ray source including an envelope that is substantially evacuated, an anode located within the envelope, and a cathode filament located in the envelope. At least one getter is located within the envelope. Means are provided for activating the getter and the apparatus includes an x-ray detector.

In accordance with a more limited aspect of the present invention, the apparatus further includes a member with an arcuate surface wherein the x-ray detector comprises a plurality of detectors disposed on the arcuate surface of the member.

In accordance with another aspect of the present invention, a method is provided for flashing a getter in an x-ray tube in an installed imaging system. The method includes the steps of determining the desirability of activating the getter based upon tube operating characteristics and the step of activating the getter.

One advantage of the present invention is that an x-ray tube that has been installed in an imaging system, and operating, can have the gas pressure reduced in the envelope by field flashing and/or field actuating a getter to improve getter pumping rate and vacuum.

Another advantage of the present invention is that the field flashing and/or actuating of the getter may be accomplished using existing standard wiring configurations, thereby allowing retrofitting of existing installations with the present invention.

Yet a further advantage of the present invention is that the imaging system controller can determine whether to activate the getter by flashing and/or actuating the getter in the x-ray tube automatically in response to sensed operating characteristics of the tube.

An additional advantage of the present invention is that it provides for more accurate control of the rate and amount of getter material deposited during a flash.

Yet a further advantage of the present invention is that a single additional getter can be flashed a number of times.

Another advantage of the present invention is that the number of electrical connections that pass through the vacuum envelope can be minimized.

The present invention provides the foregoing and other features hereinafter described and particularly pointed out in the claims. The following description and accompanying drawings set forth certain illustrative embodiments of the invention. It is to be appreciated that different embodiments of the invention may take form in various components and arrangements of components. These described embodiments being indicative of but a few of the various ways in which the principles of the invention may be employed. The drawings are only for the purpose of illustrating a preferred embodiment and alternative embodiments and are not to be construed as limiting the invention.

BRIEF DESCRIPTION OF THE DRAWINGS

The foregoing and other features and advantages of the present invention will become apparent to those skilled in the art to which the present invention relates upon consideration of the following detailed description of a preferred embodiment of the invention with reference to the accompanying drawings, wherein.

DETAILED DESCRIPTION

Figure 1:
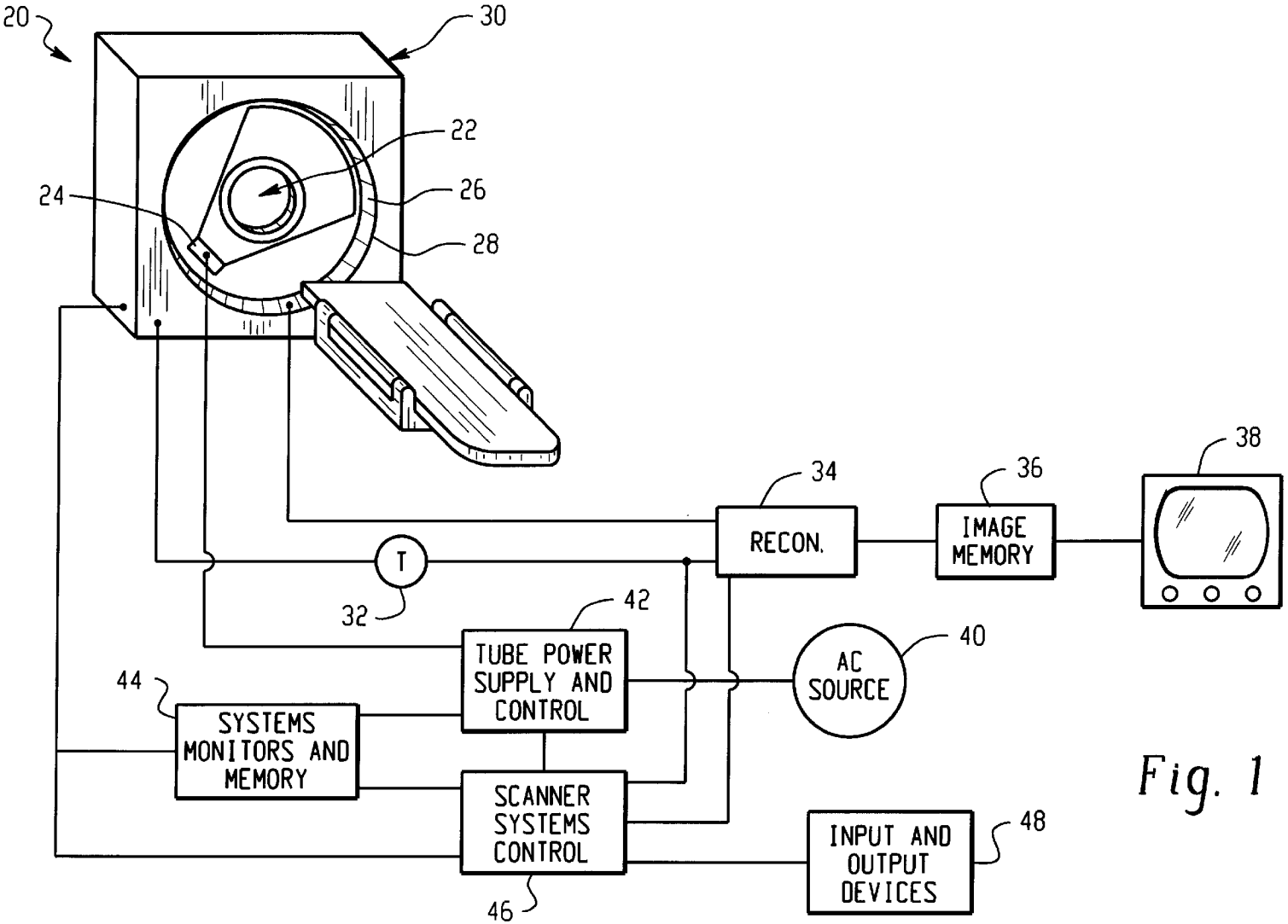
FIG. 1 is a schematic diagram of an x-ray diagnostic system in accordance with the present invention.

With reference to FIG. 1, a medical diagnostic apparatus 20 is used to examine a subject (not shown) in an examination region 22 with x-rays. More specifically, an x-ray tube 24 projects radiation through the examining region 22 and on to an x-ray detector assembly 26. In the illustrated CT scanner embodiment, the x-ray detector assembly 26 is disposed on an arcuate surface in a ring 28 on a gantry 30. The detected x-rays are converted into electrical signals which, in turn, are reconstructed into diagnostic images.

It is also contemplated that x-ray detection systems other than the described CT embodiment may be used with the present invention. For example, the medical diagnostic apparatus can be one that produces projection or shadowgraphic images on x-ray sensitive photographic film. Another alternative x-ray diagnostic apparatus can be a digital x-ray system which generates shadographic x-ray images in single or multiple energies electronically. Yet another apparatus includes fluoroscopic imaging systems. In addition, non-medical x-ray detection systems are also contemplated as well as other medical x-ray medical diagnostic systems.

The x-ray detector assembly 26 and a tachometer or angular position encoder 32 for detecting rotation or angular position of the x-ray source 24 are connected with an image reconstruction processor 34. The image reconstruction processor 34 utilizes conventional convolution and back projection or other reconstruction algorithms as are known in the art. The reconstruction processor 34 produces an electronic image representation for storage in an image memory 36. A human readable display 38, such as a video monitor, produces a diagnostic display of the reconstructed image. Generally, a video processor formats the reconstructed image data into a selected format such as a slice, projection, surface rendering, sculptured volumes and the like.

An alternating current (AC) source of power 40 is connected to an x-ray tube power supply and control 42. The x-ray tube 24 is operatively connected to the tube power supply and control 42.

A diagnostic system monitor and memory 44 is in data communication with a plurality of components of the diagnostic apparatus 20 to monitor and store desired performance characteristics to provide signals indicative of system performance. Some of the signals that are monitored are indicative of, gas pressure in the x-ray tube, arc rate, operating cycles, exposure count, number of scans, anode and cathode current and voltage, temperature, anode and cathode voltage balance, anode rotation, and a number of other desirable operating parameters known in the art. An example of a suitable monitoring system is described in U.S. Pat. No. 4,853,946 to Elliott et al., entitled "Diagnostic Service System for CT Scanners" which is incorporated herein by reference. The systems monitor and memory 44 is in data communication with the tube power supply and control 42 and a scanner systems control 46. The scanner systems control 46 is a suitable computer or microcomputer with all required systems and memory for operating the diagnostic device 20. The systems control 46 includes sufficient memory capacity to store data for controlling various scanner and tube operations in look up tables or as algorithms as desired.

The scanner systems control 46 is controllably connected with and in data communication with the operative components of the medical diagnostic apparatus 20 in a manner known in the art. Input and output devices 48 are connected to the scanner systems control 46. Input and output devices 48 may include a field service diagnostics device, an operators console, communications devices and modems, printers, monitors and other devices as appropriate. The systems control 46 manages and controls the operation of the diagnostic apparatus 20 in response to (i) inputs received from the monitored components of the apparatus 20, (ii) system operators and (iii) field service technicians via the input and output devices 48.

Figure 2:
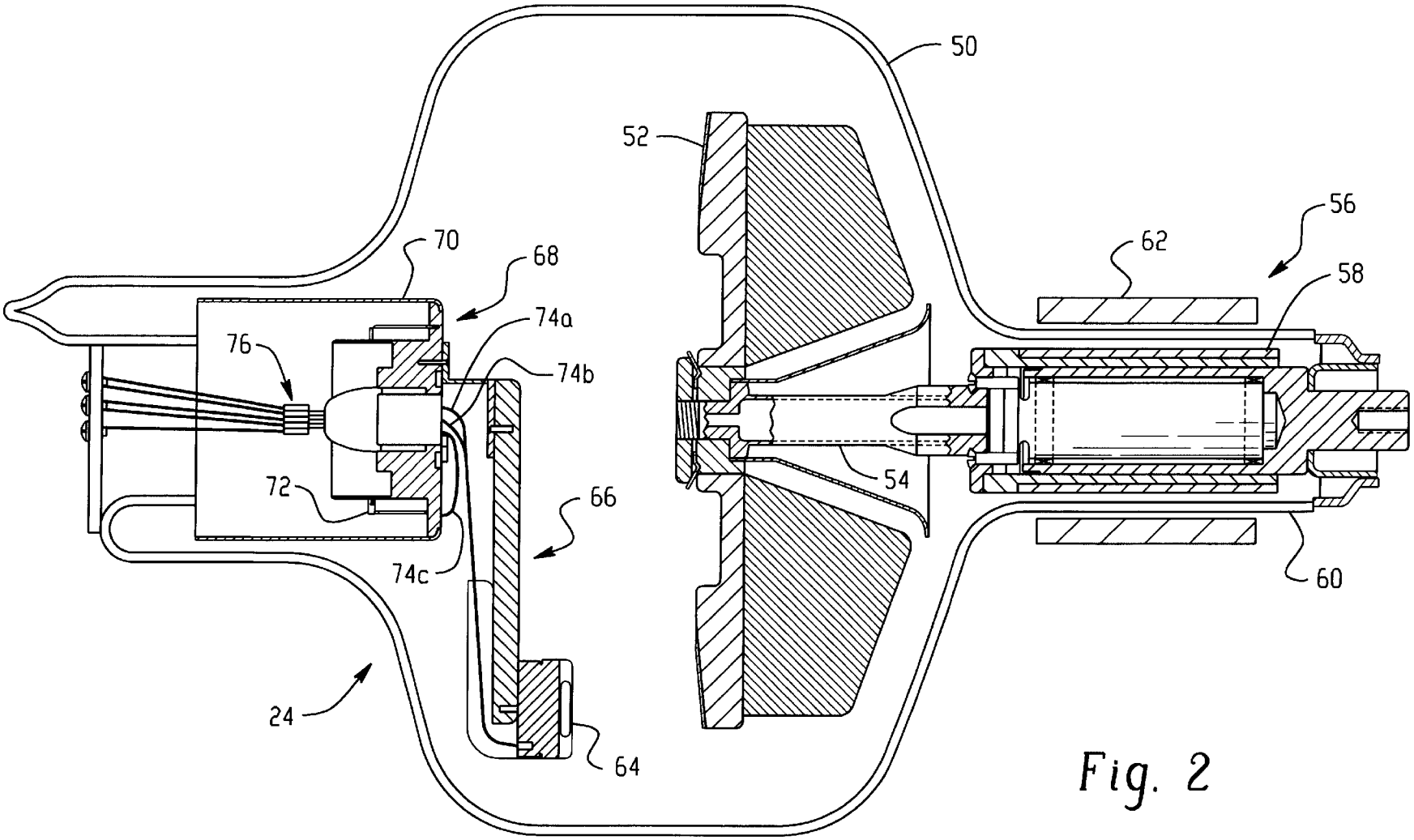
FIG. 2 is a sectional view of an x-ray tube.

Referring now to FIG. 2, the x-ray tube 24 includes an evacuated envelope 50 in which an anode 52 is rotatably mounted. The envelope 50 is preferably made of glass or metal and may be constructed of other suitable materials. The anode 52 is connected to a shaft 54 which is connected to an induction motor 56. The motor 56 includes rotor windings 58 and associated bearings (not shown) are mounted in a neck portion 60 of the evacuated envelope 50. The rotor windings 58 are electromagnetically coupled with a main stator winding 62 on the outside of the neck portion 60. The anode 52 is rotated at high speed during tube operation. It is to be appreciated that the present invention is also applicable to stationary anode x-ray tubes and other electrode vacuum tubes.

A cathode 64 is supported in the envelope 50 on a cathode support assembly 66. The cathode support assembly 66 is fixedly attached a cathode conductor feed through and header assembly 68 that is ultimately secured to the envelope 50 with a vacuum tight seal (not shown). A getter shield 70 is joined to the header assembly 68. A getter 72 is attached to the feed through and header assembly 68.

Cathode conductors 74*a, b, c* are electrically connected to feed through terminals 76 that extend through the header assembly and are connected to a plurality of conductors. Since the electrical interconnections between terminals and conductors are not apparent in this figure, the arrangement of the cathode conductors in FIG. 2 are not necessarily indicative of a specific embodiment of the present invention but is representative of an example of a physical arrangement for feeding conductors through a header to components within the envelope 50. Actual circuit connections for the cathode conductors and getters to the terminals 106*a–d* according to the present invention are described and illustrated in accordance with FIGS. 3–8 below. Like numerals are used for similar elements in the different embodiments of the present invention.

Figure 11:
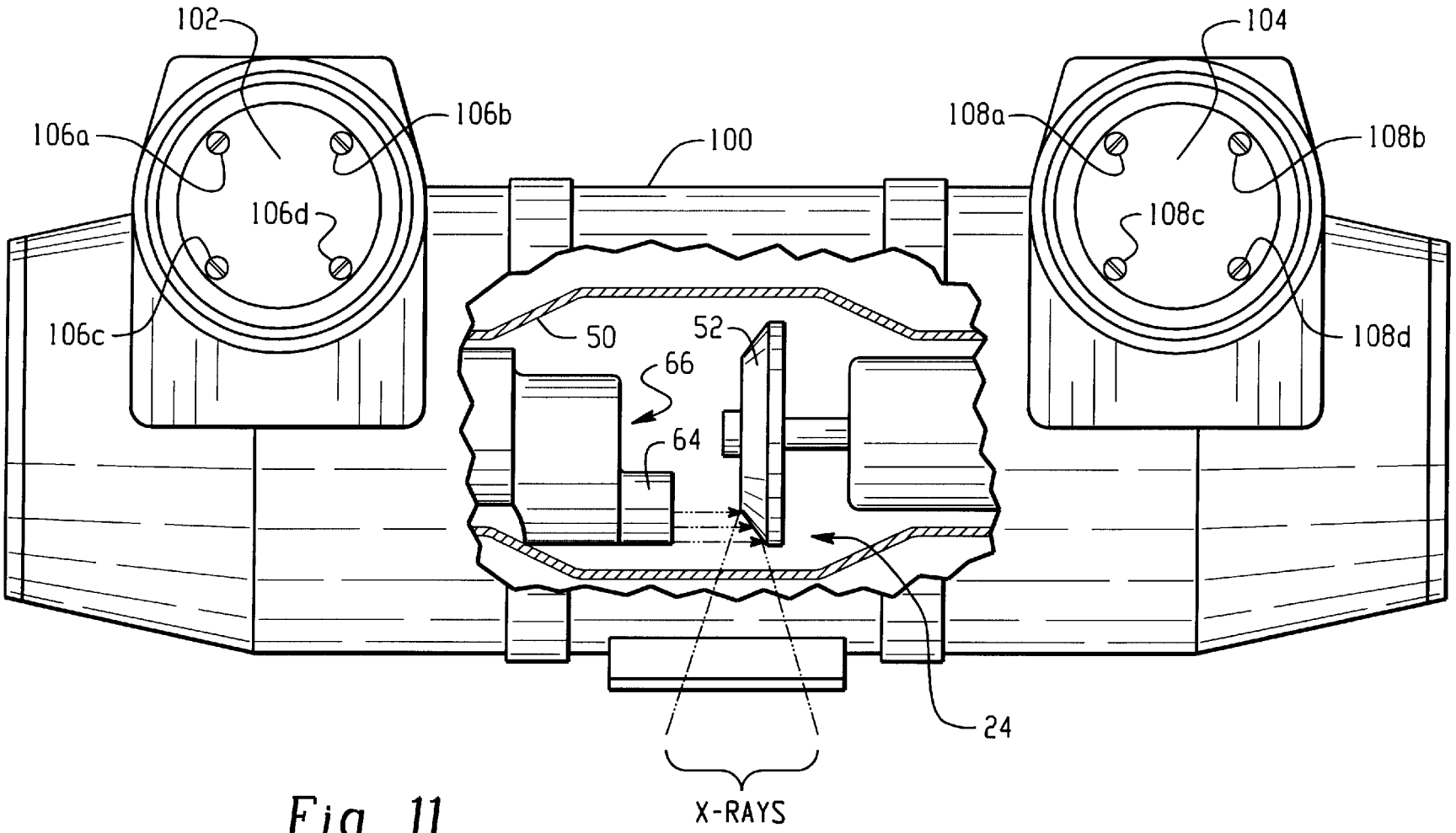
FIG. 11 is a schematic partial sectional view of an x-ray tube mounted in a housing.

Referring briefly to FIG. 11, typically, the x-ray tube 24, of FIG. 2, is mounted within an oil filled housing 100 in a manner known in the art. The housing is equipped with the necessary high voltage connectors 102, 104 and cathode terminals 106*a–d* and anode terminals 108*a–d* to provide electrical power to the enclosed x-ray tube 24. It is to be appreciated that, while FIG. 11 illustrates four terminals in the high voltage connectors 102, 104, some x-ray tubes and housings have only three terminals contained therein.

Figure 3:
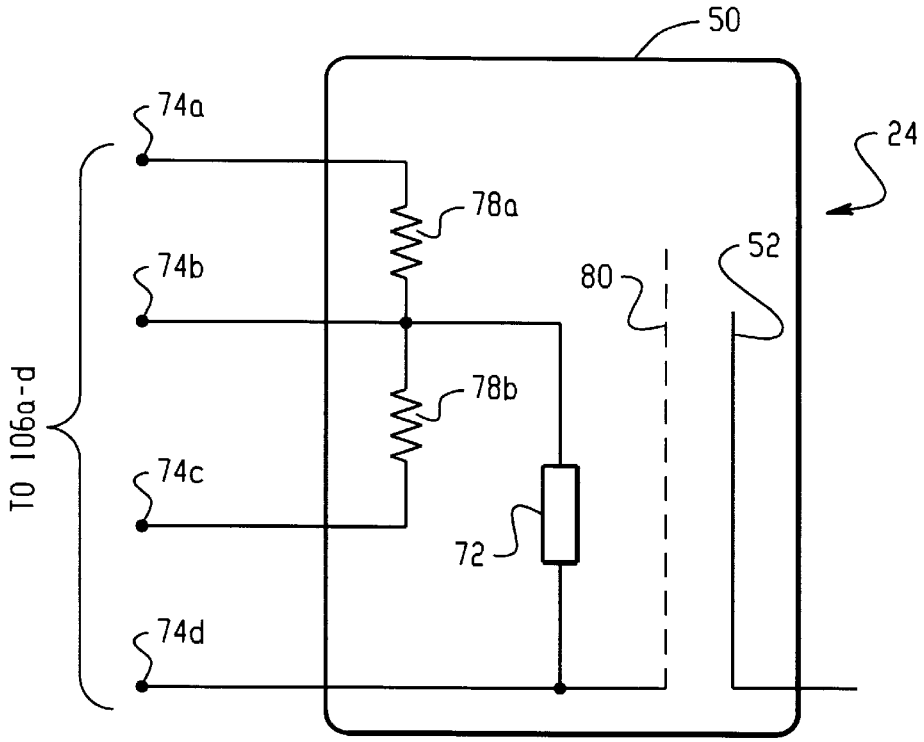
FIGS. 3–8 are schematic illustrations showing different embodiments of the present invention.

Turning now to FIG. 3, one embodiment of the present invention is illustrated. Four conductors 74*a,b,c,d*, exit the envelope 50. Conductor 74*a* is connected to a first end of a first cathode filament 78*a*. Conductor 74*b* is connected to (i) a second end of the cathode filament 78*a*, (ii) a first end of a second cathode filament 78*b*, and (iii) a first end of getter 72. Conductor 74*c* is connected to a second end of the second cathode filament 78*b*. The conductor 74*d* is connected to a second end of getter 72 and to a cathode grid cup 80.

Presently designed and installed imaging systems have high voltage connectors with a fixed number of conductor terminals or contacts, e.g. a four (4) pin connector. Flashing the getter 72 in the field using an x-ray tube according to the present invention can be accomplished in presently designed imaging systems by removal of the four pin high voltage connector (not shown) on the cathode side of the x-ray tube housing and having the service technician apply the desired voltage and current to terminals 74*b* and 74*d* to flash the getter and deposit the desired amount of getter material within the envelope 50. The current flow in the getter conductors heats the getter material in contact with the conductors. The heated getter material evaporates and atoms leaving the getter surface are deposited on interior surfaces of the envelope and other internal components. The freshly deposited getter material plated on the interior surfaces absorb additional amounts of residual gas molecules. The tube may remain within the oil filled tube housing during this process. Thus, the flashed getter is activated since the reacted layer is now plated over with fresh material. Alternatively, a bulk getter may be actuated by having electric current applied to it for a predetermined period of time. The bulk getter thereby has its temperature raised to that required to absorb specific gas molecules. The getter is actuated for the time period required to pump a sufficient number of the evolved gas molecules and reduce the gas pressure in the tube.

It also is contemplated that an x-ray tube and associated housing be provided such that a getter has dedicated conductors. The getter conductors are advantageously connected to permit flashing of the getter in the field without requiring the removal of the high voltage connection. Such getter conductors could be easily accessible on new tube and housing designs to a service technician or permanently connected to a proper source of electrical energy that may be manually or automatically controlled to activate the getter by flashing or actuating.

Figure 4:
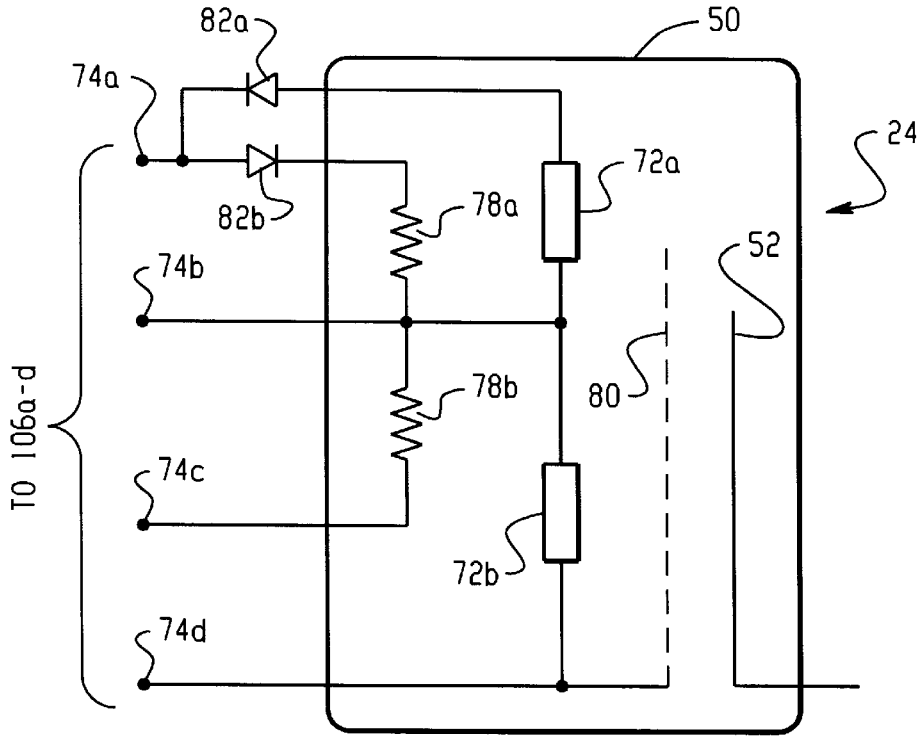

Another embodiment of the present invention, as seen in FIG. 4, includes diodes 82*a*, 82*b* to direct the flow of desired DC current in the cathode filament an x-ray tube. The cathode of the diode 82*a* is connected to the conductor 74*a*. The anode of the diode 82*a* is connected to a first end of a getter 72*a*. A second end of the getter 72*a* is connected to the conductor 74*b*. The anode of the diode 82*b* is connected to the conductor 74*a* and the cathode of the diode 82*b* is connected to the cathode filament 78*a*. The other end of the cathode filament 78*a* is connected to the conductor 74*b*. A second getter 72*b* is connected to the conductor 74*b* and to the conductor 74*d*. A second cathode filament 78*b* is connected to the conductor 74*b* and the conductor 74*c*. The cathode grid cup 80 is connected to the conductor 74*d*.

With continuing reference to FIG. 4, under normal tube operation, the cathode filament 78*a* is energized using conductors 74*a*, 74*b*. The diode 82*b* permits the desired and appropriately polarized DC current to flow from conductor 74*a* through the cathode filament 78*a*. The getter 72*a* is flashed by reversing the DC polarity on the conductors 74*b*, 74*a* such that the diode 82*a* permits flow of appropriate current from conductor 74*b* through the getter 72*a* and conductor 74*a*. This embodiment of the present invention has five conductors exiting the tube envelope 50 but still has only four conductor terminals for the four pin high voltage connector (not shown) to be connected with the four conductors 74*a, b, c, d*. It is to be appreciated that the diodes may be located within the envelope 50 thereby having only four conductors exiting the tube envelope 50.

Figure 5:
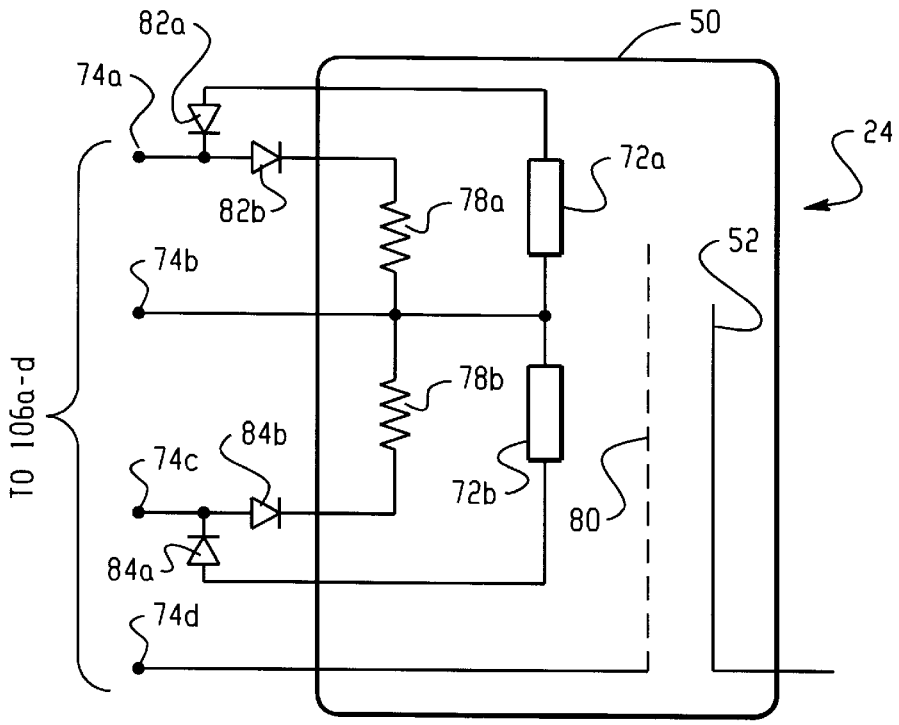

Referring now to FIG. 5, another embodiment of the present invention is shown. Diodes 82*a*, 82*b* and 84*a*, 84*b* direct the flow of desired DC current in the cathode filament of an x-ray tube. The cathode of the diode 82*a* is connected to the conductor 74*a*. The anode of the diode 82*a* is connected to a first end of a getter 72*a*. A second end of the getter 72*a* is connected to the conductor 74*b*. The anode of the diode 82*b* is connected to the conductor 74*a* and its cathode is connected to the cathode filament 78*a*. The other end of the cathode filament 78*a* is connected to the conductor 74*b*. A second getter 72*b* is connected to the conductor 74*b* and to the anode of a diode 84*a*. The cathode of the diode 84*a* is connected to the conductor 74*c*. A second cathode filament 78*b* is connected to the conductor 74*b* and the cathode of a diode 84*b*. The anode of the diode 84*b* is connected to conductor 74*c*. The cathode grid cup 80 is connected to the conductor 74*d*. This embodiment of the present invention has six conductors exiting the tube envelope 50 but still has only four conductor terminals for the four pin high voltage connector (not shown) to be connected with the four conductors 74*a, b, c, d*. It is to be appreciated that the diodes may be located within the envelope 50 thereby having only four conductors exiting the tube envelope 50.

This arrangement, illustrated in FIG. 5, permits using the components of the x-ray tube to monitor gas pressure in the evacuated envelope with known ionization gauge techniques. Basically electrons are accelerated between the cathode and the grid, but cannot reach the anode since it is connected at a negative potential. Some electrons, however, collide with gas molecules in the tube and ionize them, leaving them positively charged. The positively charged gas molecules then go to the anode and the anode current produced provides a measure indicative of the number of gas molecules present in the evacuated envelope.

Figure 6:
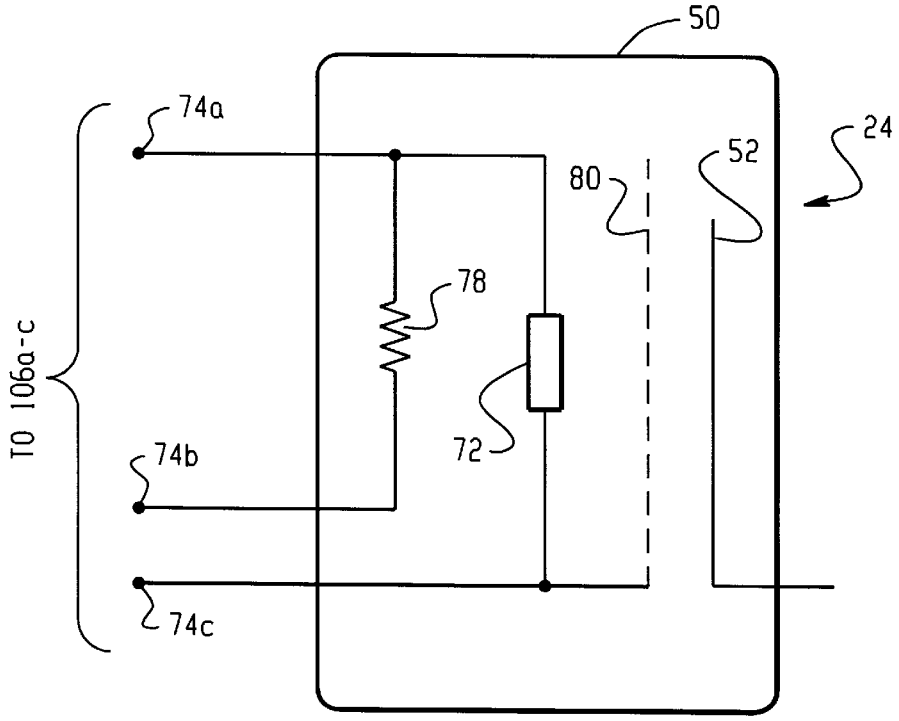

In FIG. 6, another embodiment of the present invention is shown that has a single cathode filament 78 attached between the conductors 74*a* and 74*b*. A single getter 72 is attached between the conductors 74*a* and 74*c*. The cathode grid cup 80 is connected to the conductor 74*c*.

Figure 7:
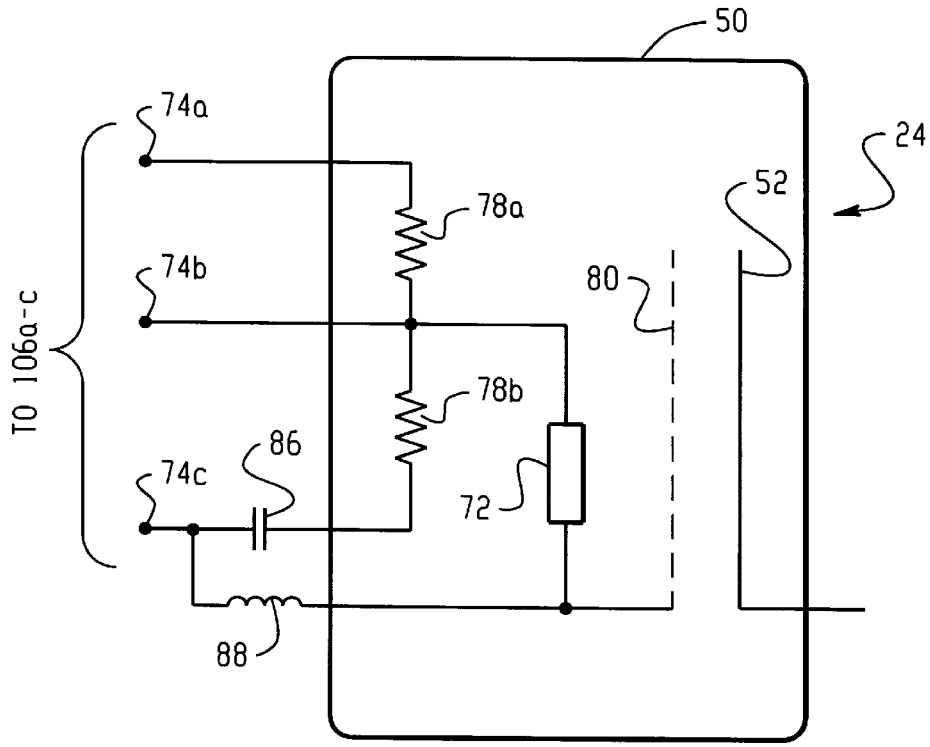

Turning now to FIG. 7, a preferred embodiment of the present invention is described. The x-ray tube 24 is one that applies alternating current (AC) to the cathode filaments 78*a*, 78*b* through the conductors 74*a*, 74*b*, and 74*c*. A capacitor 86 is connected between the conductor 74*c* and the cathode filament 78*b*. The other end of the cathode filament 78*b* is connected to conductor 74*b*. The cathode filament 78*a* is connected between the conductors 74*a* and 74*b*. In addition, one end of the getter 72 is connected to the conductor 74*b* and the other end is connected to one terminal of an inductor 88. The other end of the inductor 88 is connected to the conductor 74*c*. The cathode grid cup 80 is connected to the inductor 88 and the getter 72.

The filaments 78*a*, 78*b* operate with AC current supplied between conductor 74*b* and 74*a* or 74*c*. Under normal operation, the inductor 88 resists the flow of AC current through the getter 72 to a level insufficient to flash the getter. The capacitor 86 is advantageously selected to permit flow of sufficient AC current through the cathode filament 78*b* for tube operation and to effectively limit DC current in the filament during getter flashing. To flash the getter 72, DC current is applied by an appropriate source to the conductors 74*b* and 74*c*.

Figure 8:
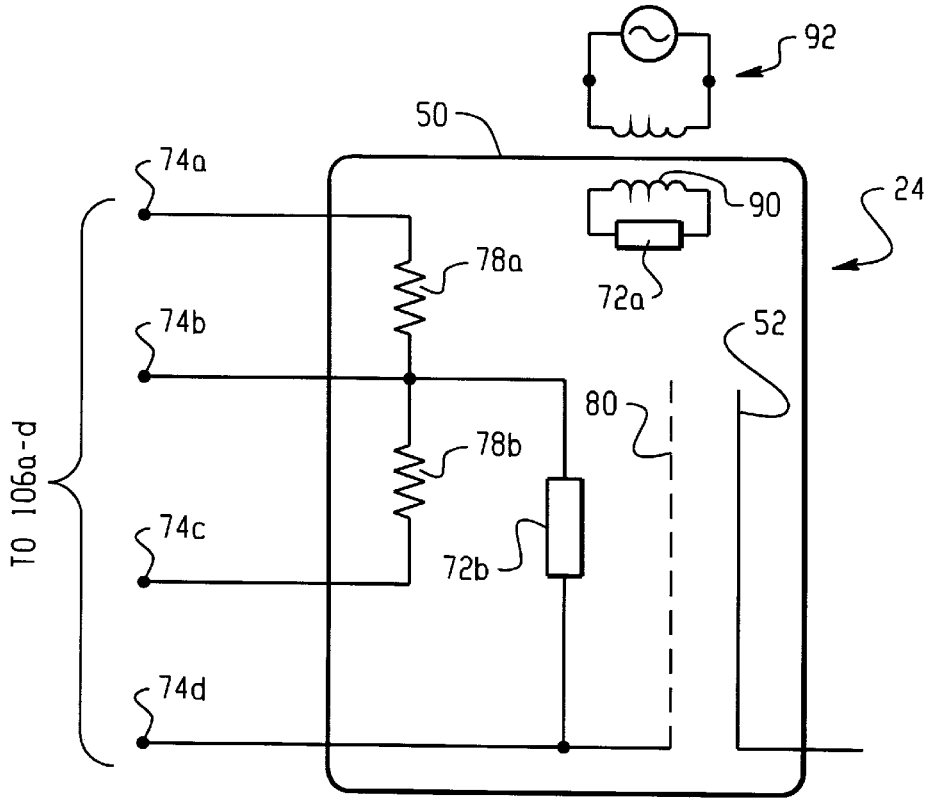

Another embodiment of the present invention is shown in FIG. 8 where a getter 72*a* is installed in the tube and is connected in a loop with an inductor 90, or coil, in a manner known in the art. The getter is advantageously placed in the envelope 50 for RF flashing by electromagnetic coupling to an RF source 92 during tube manufacture, prior to assembly in the oil filled tube enclosure. A second getter 72*b* may be installed in the tube in any of the manners described above for field flashing purposes.

The getters 72, 72*a*, 72*b* in the embodiments described above can be automatically flashed by the controller 46 of the diagnostic system 20 in response to monitored operating parameters. Typical parameters include signals indicative of gas pressure in the tube, exposure count, number of scans, arcing, temperature, voltage and current of the anode and/or cathode, anode rotation and other desired system operating parameters or ratios of such parameters. In addition, historical data of these parameters over a predetermined time period may be stored in the systems monitor and memory 44. All of these data can be accessed by the controller 46 and trend analysis compared to predetermined criteria for use in determining the desirability or need to flash the getter in an installed system.

In addition, the getters 72, 72*a*, 72*b* described above may be partially flashed during the manufacturing process to establish the desired initial vacuum while reserving a portion of getter material for future field service flashing of the getter to re-establish the desired vacuum in a tube that has been in service.

Figure 9:
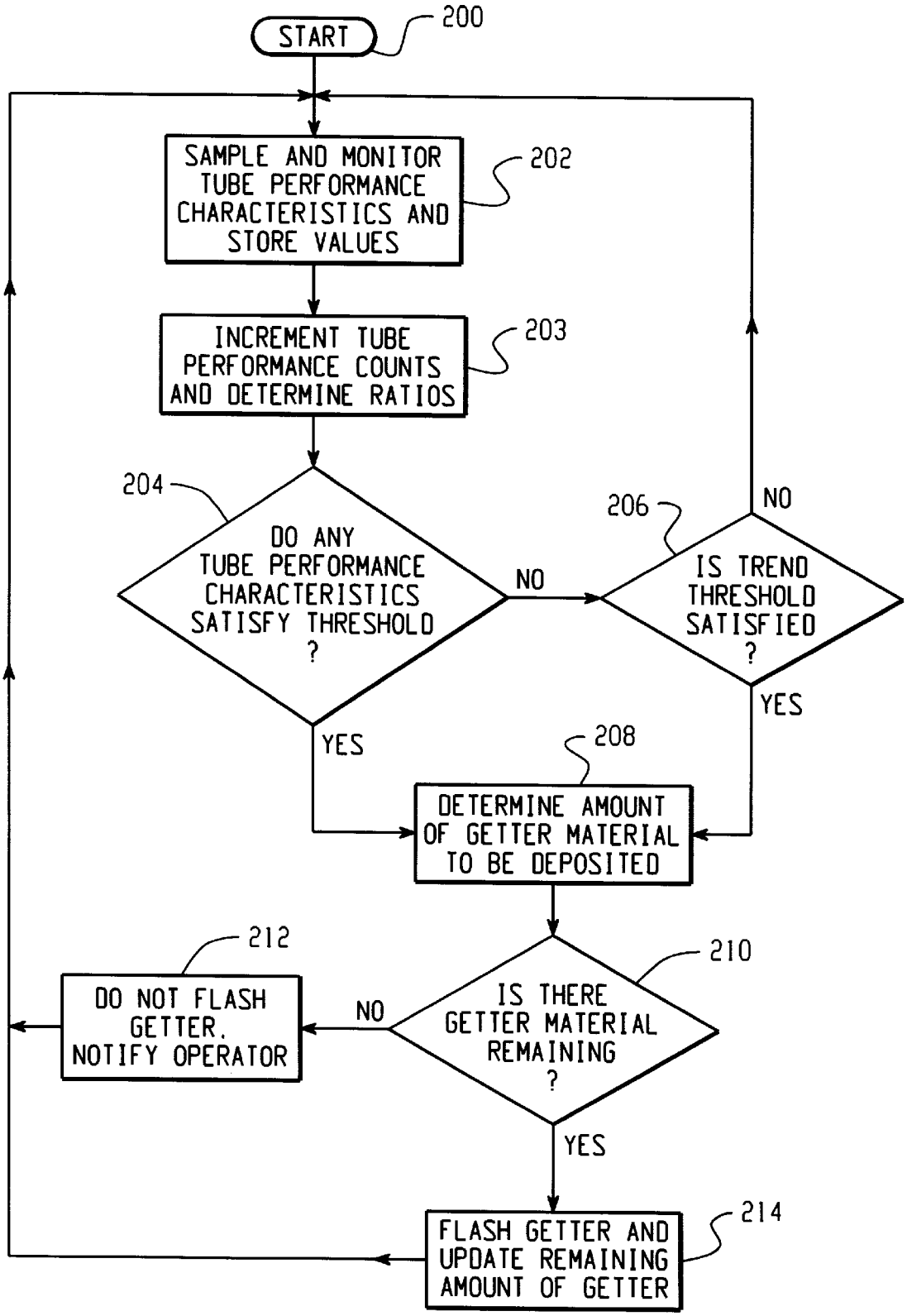
FIG. 9 is a flow diagram of a control process in accordance with the present invention.

Referring now to FIG. 9, a flow chart of a suitable control process for the present invention to automatically flash a getter installed in the field in response to monitored operating parameters is shown. Beginning in step 200, the system is initialized and the process starts. In step 202, sample values of tube performance characteristics and number of exposures etc. are obtained. Next, in step 203, exposure counts etc. are incremented, and ratios are determined. The various values and ratios are stored in memory, as desired. The process then proceeds to step 204 where a determination is made as to whether any one of the parameters, or combination of them, is over or under a predetermined threshold or combination of thresholds. The particular predetermined threshold for a monitored operating parameter or ratio is advantageously established for each of the specified monitored operating parameters or ratios.

For example, if gas pressure within the tube is determined to be greater than a predetermined value, perhaps 50 $\mu$Torr for a specific tube design, then it is desirable to flash the getter. Alternatively, once exposure count exceeds a predetermined threshold, say 60,000 exposures for a specific tube design, then it is desirable to flash the getter. Similar threshold values may be determined for other monitored operating parameters, including those listed above as well as others. It is to be appreciated that the threshold values described herein are examples of the inventive principles of the invention and are not limitations since different tube designs have different operating parameters and thereby may utilize different threshold values for different tube designs.

In addition, a combination of any number of the monitored parameters may be used to determine the desirability of flashing the getter. For example, if the number of exposures is greater than a predetermined value, say 30,000 exposures, and the arc rate is exceeds a predetermined rate, say 1 arc per 5,000 exposures, then it may be desirable to flash the getter. Such an approach may be desirable when neither of the monitored parameters satisfied its respective individual threshold value for flashing the getter, e.g. 60,000 exposures and 1 arc per 3,000 exposures, but the combination indicates a need to flash the getter.

If the monitored operating parameter does not satisfy the predetermined threshold test, indicating that it is desirable to flash the getter, the process progresses to step 208. If the monitored operating parameter satisfies the threshold test, indicating that the monitored value is within the limits that do not require flashing the getter, the answer to step 204 is NO and the process proceeds to step 206.

In step 206, the stored values of the operating parameters are analyzed for trend characteristics and compared to predetermined trend values. For example, if tube operating temperature is increasing as the exposure count increases, it may be desirable to flash the getter. If the trend analysis indicates that the trend values are satisfied, indicating that flashing is not required, the process returns to step 202. If the trend values are compared to the predetermined trend values and are not satisfied, indicating that it is desirable to flash the getter, the process proceeds to step 208.

In step 208, the scanner systems control 46 determines the amount of getter material to be deposited in response to the received value. For example, if gas pressure is at a predetermined level for a particular tube design, a specified amount of getter is required to be deposited to reduce gas pressure to a desired level. Alternatively, exposure count may dictate when and how much getter material is deposited. For example a typical x-ray tube may have an exposure count service life of 40,000–100,000 exposures. At 50% of tube service life a predetermined portion of the getter may be deposited. At 75% of service life another predetermined portion may be deposited. Each of the other operating parameters, ratios and trend data may be used in a similar manner to determine the amount of getter material to be deposited during a field flash, whether automatically or manually.

Figure 10:
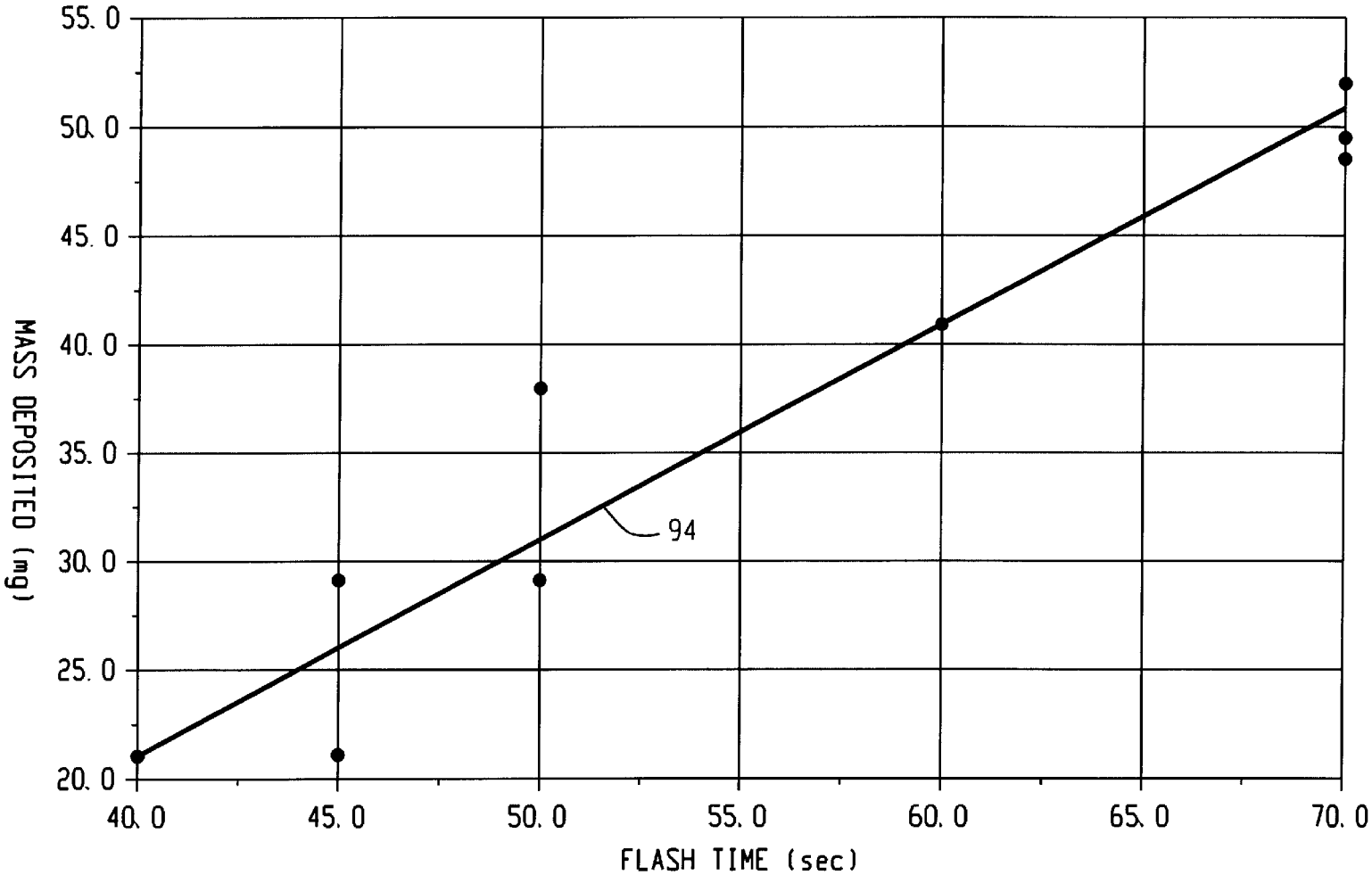
FIG. 10 is a graphical representation of the mass of getter material deposited over time for a given current value during a getter flash.

Referring briefly to FIG. 10, a graph illustrates the mass of preferred getter material, Barium, deposited at a getter flash current of 10 amps over a duration of time. The data represented in this graph can be used by the controller to control the amount of getter material deposited during a getter flash. Other suitable getter materials to evaporate include titanium and tantalum. It is to be appreciated that other flash currents, time periods and deposit amounts may be used in the present invention. A line 94 can be determined from the points of data and may be stored in a look up table or an algorithm as desired.

Returning again to FIG. 9, once the amount of getter material to be deposited is determined in step 208, using the data in FIG. 10, the process progresses to step 210 where a determination is made as to whether there is any getter material remaining that can be flashed. If the answer is negative the process advances to step 212. In step 212, the controller 46 does not instruct the tube power supply and control 42 to flash the getter and an instruction is given to actuate an indicator to communicate to the operator that tube operating parameters indicate a decline in tube performance and there is not any getter material to flash to improve the vacuum in the tube. If the determination in step 210 is affirmative, indicating that there is some getter material available to flash, the process proceeds to step 214.

In step 214, the scanner systems control 44 instructs the tube power supply and control 42 to provide the appropriate current to the appropriate conductors 74*a, b, c, d* to deposit the desired mass of getter material in accordance with FIG. 10 and the requirements of the embodiments described above in FIGS. 3–8. Once the getter material is flashed the process returns to step 202.

It is also contemplated that a service diagnostic unit for the scanner system may be included in the input and output device 48. The service diagnostic unit may be interfaced by a service technician to either monitor system operating parameters or access stored data from the systems monitor and memory 44. The service technician may then manually flash the getter in the tube rather than automatically having the scanner control system 46 flash the getter.

In addition, electrical power can be applied to the cathode filaments and getters using a fiber optic controlled switching apparatus. A suitable example of a fiber optic switching apparatus and method for use in the present invention is disclosed in U.S. Pat. No. 4,685,118 issued to Furbee et al., which is fully incorporated herein by this reference.

While a particular feature of the invention may have been described above with respect to only one of the illustrated embodiments, such features may be combined with one or more other features of other embodiments, as may be desired and advantageous for any given particular application.

From the above description of the invention, those skilled in the art will perceive improvements, changes and modification. Such improvements, changes and modification within the skill of the art are intended to be covered by the appended claims.

Having described a preferred embodiment of the invention, the following is claimed:

1. An x-ray tube comprising:

an envelope, the envelope substantially evacuated;

an anode located within the envelope;

a cathode filament located within the envelope;

at least one getter located within the envelope; and at least one conductor electrically connected to both of the cathode filament and the getter.

2. The x-ray tube of claim 1 including means for selectively activating at least one of the cathode filament and the getter.

3. The x-ray tube of claim 1 further including a second conductor electrically connected to the cathode filament and a third conductor electrically connected to the getter.

4. The x-ray tube of claim 2 wherein the means for selectively activating at least one of the cathode filament and the getter includes a diode.

5. The x-ray tube of claim 4 wherein the diode is connected in series with the getter.

6. The x-ray tube of claim 4 wherein the diode is located outside of the envelope.

7. The x-ray tube of claim 4 wherein the means for selectively activating at least one of the cathode filament and the getter includes a capacitor.

8. The x-ray tube of claim 7 wherein the capacitor is connected in series with the cathode filament.

9. The x-ray tube of claim 7 wherein the capacitor is located outside the envelope.

10. The x-ray tube of claim 1 including a plurality of getters within the envelope.

11. The x-ray tube of claim 10 wherein at least one of the plurality of getters is activated by flashing.

12. The x-ray tube of claim 11 including means for selectively flashing at least one of the plurality of getters.

13. The x-ray tube of claim 10 including means for selectively activating the at least one of the plurality of getters.

14. An apparatus for use in an evacuated tube envelope, the apparatus comprising:

an electrode in the tube envelope;

a getter in the tube envelope;

a conductor electrically connected to both of the electrode and the getter; and means for selectively providing electrical energy through the conductor to one of the electrode and the getter.

15. The apparatus of claim 14 further including a second conductor electrically connected to the electrode and a third conductor electrically connected to the getter.

16. The apparatus of claim 14 wherein the electrode is a cathode.

17. The apparatus of claim 14 wherein the means for selectively providing electrical energy includes a diode electrically connected to the getter.

18. The apparatus of claim 14 wherein the means for selectively providing electrical energy includes an inductor electrically connected to the getter.

19. The apparatus of claim 14 wherein the evacuated tube envelope is an x-ray tube.

20. The apparatus of claim 14 including a plurality of getters wherein at least one of the getters is activated by flashing.

21. The apparatus of claim 20 including means for selectively providing electrical energy to at least one of the plurality of getters.

22. The apparatus of claim 21 wherein the means for selectively providing electrical energy to the at least one of the plurality of getters includes a diode.

23. The apparatus of claim 21 wherein the means for selectively providing electrical energy to the at least one of the plurality of getters includes an inductor.

24. The apparatus of claim 14 wherein the means for selectively providing electrical energy includes a fiber optic transmission path.

25. An apparatus for activating a getter in an enclosed tube, the getter electrically connected to a conductor extending through a wall of the tube, the apparatus comprising:

means for providing a signal indicative of tube performance; and means for activating the getter in response to the signal indicative of tube performance.

26. The apparatus of claim 25 wherein the means for activating includes a controller in data communication with the means for providing a signal.

27. The apparatus of claim 25 wherein the signal indicative of tube performance includes a signal indicative of at least one of arc rate, gas pressure, operating cycles, starts, exposures, number of scans, current, voltage and temperature.

28. The apparatus of claim 25 wherein the means for activating includes a diode.

29. The apparatus of claim 25 wherein the means for activating includes a capacitor.

30. An apparatus for controllably activating a getter in an envelope comprising:

a pressure measuring device advantageously located to determine a measure of the gas pressure within the envelope, the pressure measuring device providing a signal indicative of the measure of gas pressure within the envelope;

a source of electrical energy operatively connected to the getter; and a controller controllably connected to both of (i) the pressure measuring device and (ii) the source of electrical energy, the controller controlling the source of electrical energy in response to the signal provided by the pressure measuring device.

31. The apparatus of claim 30 wherein the controller determines the amount of electrical energy to apply to the getter in response to the signal provided by the pressure measuring device.

32. The apparatus of claim 30 wherein the pressure measuring device is an ionization gauge.

33. The apparatus of claim 32 wherein the ionization gauge includes an anode and a cathode located within the envelope.

34. The apparatus of claim 30 wherein the envelope is substantially evacuated.

35. An apparatus comprising:

an envelope that is substantially evacuated;

a first getter located within the envelope, the first getter having a first end electrically connected to a first terminal extending through the envelope and a second end electrically connected to a second terminal extending through the envelope; and a second getter located within the envelope.

36. The apparatus of claim 35 wherein the second getter has a first end electrically connected to a third terminal extending through the envelope and a second end electrically connected to at least one of the first and second terminal.

37. The apparatus of claim 35 wherein the apparatus is an x-ray tube.

38. A method of maintaining a pressure level in an evacuated enclosed electrode tube, the method comprising the steps of:

providing a signal indicative of electrode tube performance; and activating getter material in response to the signal indicative of tube performance.

39. The method of claim 38 wherein the signal indicative of tube performance includes at least one of arc rate, gas pressure, exposure count, number of scans, operating cycles, starts, current, voltage and temperature.

40. The method of claim 38 wherein the step of activating the getter includes the step of evaporating getter material.

41. The method of claim 38 including the step of determining the amount of getter material to evaporate prior to the step of activating.

42. The method of claim 41 wherein the step of activating the getter includes the step of controlling the amount of getter material evaporated.

43. The method of claim 42 wherein only a portion of the getter material is evaporated for a discrete activation step.

44. The method of claim 43 including the step of determining the amount of getter material remaining.

45. The method of claim 38 including the steps of monitoring the signals indicative of tube performance and storing values associated with the monitored signals.

46. A method of maintaining a substantial vacuum in an x-ray tube, the method comprising the steps of:

sensing gas pressure in the tube and providing a signal indicative of the gas pressure; and activating the getter material in response to the signal.

47. The method of claim 46 including the step of determining an amount of getter material to activate in response to the signal indicative of gas pressure.

48. The method of claim 46 wherein the step of activating the getter includes the step of evaporating getter material.

49. The method of claim 48 wherein the step of activating the getter includes the step of controlling the amount of getter material evaporated.

50. The method of claim 46 wherein only a portion of the getter material is evaporated.

51. The method of claim 46 wherein the step of sensing the gas pressure in a tube includes using an ionization gauge.

52. The method of claim 51 wherein the step of using the ionization gauge includes using an anode and a cathode in an x-ray tube.

53. An imaging apparatus, the apparatus comprising:

a housing;

an x-ray source enclosed in the housing including:

an envelope, the envelope substantially evacuated;

an anode located within the envelope;

a cathode filament located in the envelope; and at least one getter located within the envelope; means for activating the getter; and an x-ray detector.

54. The apparatus of claim 53 further including a member with an arcuate surface and wherein the x-ray detector comprises a plurality of detectors disposed on the arcuate surface of the member.

55. A method of field flashing a getter in an x-ray tube in an installed imaging system, the method including the steps of:

determining an operating characteristic of the x-ray tube; and activating the getter in response to the determined operating characteristic.

56. The method of claim 55 wherein the step of activating the getter includes the step of changing polarity of the power applied to the x-ray tube.

57. The method of claim 55 wherein the step of activating the getter includes the step of applying one of an alternating current source and a direct current source to the x-ray tube.

* * * * *